United States Patent [19]

Devir

[11] Patent Number: 4,979,082

[45] Date of Patent: Dec. 18, 1990

[54] RELIEVED PLASTIC LAMP BASE

[75] Inventor: Daniel D. Devir, Sutton, N.H.

[73] Assignee: GTE Products Corporation, Danvers, Mass.

[21] Appl. No.: 360,679

[22] Filed: Jun. 2, 1989

[51] Int. Cl.[5] ..... H01R 33/00

[52] U.S. Cl. ..... 362/226; 313/318; 439/619

[58] Field of Search ..... 362/226, 61, 80; 313/318; 439/611, 619

[56] References Cited

U.S. PATENT DOCUMENTS

| | | | |
|---|---|---|---|
| 3,001,097 | 9/1961 | Smialek | 313/318 |
| 3,286,088 | 11/1966 | Ahroni | 362/226 |
| 4,724,353 | 2/1988 | Devir | 313/318 |

FOREIGN PATENT DOCUMENTS

| | | | |
|---|---|---|---|
| 1111810 | 11/1981 | Canada | 362/226 |
| 1452345 | 8/1966 | France | 362/226 |

*Primary Examiner*—Stephen F. Husar
*Assistant Examiner*—D. M. Cox

[57] ABSTRACT

A relieved plastic lamp base has been discovered to substantially eliminated cracking of the captured press seal. The relieved base has a formed cavity for receiving the press seal of an electric lamp. The cavity has a first internal base wall to couple with a first exterior lamp wall of the lamp, a second internal base wall to couple with a second exterior lamp wall of the lamp and, cavity portion formed in the internal base wall intermediate the first interior wall and second interior wall of the lamp. The relief cavity is opposite a seam area of the press seal when the press seal is positioned in the lamp base. The relief accommodates excess material due to tool variations, tool wear, and press variations and thereby allows longer tool operation between tooling changes. The relief also accepts a wider variation in noncritical seal measurements. The relief lessens the likelihood of chipping the seal corner, and displaces the holding forces that tend to open a corner chip.

7 Claims, 4 Drawing Sheets

RELIEVED PLASTIC LAMP BASE

Technical Field

The invention relates to electric lamps and particularly to electric lamps with press seals. More particularly the invention is concerned with electric lamps with press seals used in combination with molded bases coupled to the press seal.

BACKGROUND ART

Press sealed lamps have been used with metal clamp structures to position the lamp for many years. Typically the press seal has a groove, slot, bump or some other formation that is used to align the lamp with respect to the metal support. The metal clamp is then integrated with a lamp base for final electrical connection and mechanical positioning. The coupling of the press seal and clamp requires some thought. Since the two materials are hard, a variance in the manufacture of either component is not easily accommodated. Where the base alignment is improper, the lamp filament may be mispositioned with respect to the expected optical path. Where the components are too tight, or too loose, separation or breakage during assembly or replacement may occur. Examples of press seal lamps with metal bases may be seen in U.S.Pat. No. 3,001,097 and U.S. Pat. No. 3,256,508.

A generally useful method is to form a hard protective base, with an oversized cavity to receive the press seal. The excess cavity volume is then filled with a cement that hardens around the press seal when the lamp is correctly positioned. Unfortunately, cementing and individually aligning each lamp is time consuming, and therefore expensive in terms of mass production. Examples of press seal lamps with cemented bases may be seen in U.S. Pat. No. 4,243,907 and U.S. Pat. No. 4,785,218.

Applicant in a U.S. Pat. No. 4,603,278, 4,752,710 and 4,724,353 described lamp and base structures using a molded lamp base. In essence, applicant described a press seal lamp captured in a molded plastic base. The base in one embodiment has a clipping cavity to receive the press seal. The plastic has sufficient flexibility to open slightly to receive the inserted press seal, but is sufficiently hard to hold the inserted lamp firmly in a nearly fixed position. The lamp leads are extended out through holes in the bottom of the plastic base and folded over the exterior surface of the base where they are captured in formed surface features and held for electrical contact. These molded plastic base lamps have proved to be commercially successful, and are currently made in the millions for use as automobile taillights.

A small percentage of the plastic base lamps fail. The failed lamps generally do not fail immediately after manufacture, but take a period of time to fail. Some of the failed lamps show a crack in the press seal. Since the press seals are not cracked prior to insertion, do not crack during insertion, and are substantially protected from abusive contact once they are positioned in the plastic bases, it is has not been apparent what causes the press seal cracking. Applicant has discovered a cause for the press seal cracks and now teaches a solution to the problem.

DISCLOSURE OF THE INVENTION

Cracking of the press seal of an electric lamp captured in plastic base, where the press seal has at least one lamp corner region formed intermediate a first exterior lamp wall, and a second exterior lamp wall, has been discovered to be substantially eliminated by a relieved lamp base comprising a molded lamp base having a formed cavity to receive the press seal, the cavity having a first internal base wall to couple with a portion of the first exterior lamp wall, and forming an internal base corner region with a second internal base wall to couple with a portion of the second exterior lamp wall, with a relieved wall portion formed in the internal base wall of the base corner intermediate the first interior wall and second interior wall and opposite the lamp corner region when the press seal is positioned in the base cavity whereby the base corner is offset from the lamp corner. The lamp base is further improved by applying sharply focused flames to the corner regions of the press seal. The flames are preferrably applied after press sealing for a brief period to slightly smooth the corner regions.

BEST MODE FOR CARRYING OUT THE INVENTION

Figure 1:
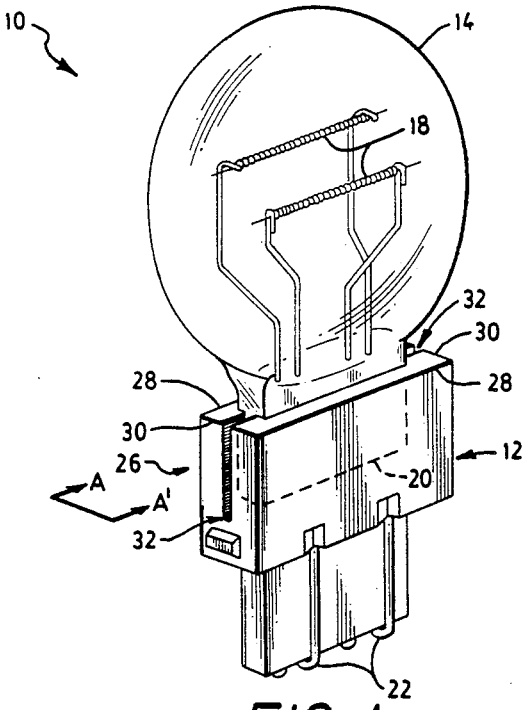
FIG. 1 PRIOR ART
FIG. 1 shows a prior art example of a press sealed lamp positioned in a plastic base.

FIG. 1 shows a prior art example of a press sealed lamp positioned in a plastic base. The lamp 10 and base 12 shown are taken from U.S. Pat. No. 4,752,710 wherein details for the design and manufacture of the lamp and base may be found and is therefore hereby incorporated by reference. The prior art lamp shows a lamp envelope 14 enclosing a volume including two lamp filaments 18. An end of the lamp envelope is narrowed to form an essentially rectangular extension, the press seal 20. The filaments 18 are electrically connected through the press seal 20 to the exterior by lamp leads 22. The plastic base 12 encloses the press seal 20 in a generally rectangular base cavity 26. The lamp base 12 is substantially rectangular with two long walls 28 and two short walls 30. The short walls 30 each include a gap 32 allowing the long walls 28 to move slightly with respect to each other. The press seal 20 may then be captured in the base cavity 26 between the surrounding cavity walls. The lamp leads 22 in the embodiment shown extend through the molded base 12, and are then folded back across the lamp base 12 to be captured in surface structures that position, and hold the lamp leads 22 fixed, and exposed for electrical contact.

Figure 2:
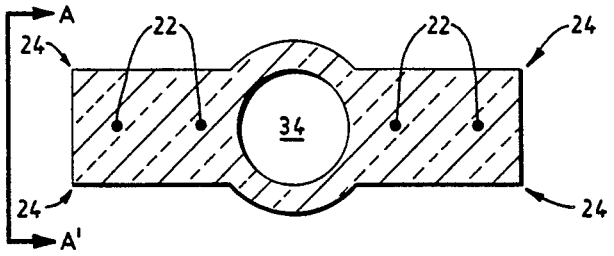
FIG. 2 PRIOR ART
FIG. 2 shows a cross sectional view of a prior art press seal.

FIG. 2 shows a cross sectional view of a prior art press seal. In cross section the press seal 20 is shown as being substantially rectangular, although a tubulation passage 34 may extend through the middle of the press seal 20 flanked by two pairs of lamp leads 22. The press seal 20 may also include formed surface features (not shown), such as bumps or cavities to enhance the alignment or coupling between the press seal 20 and molded base 12. Intermediate the exterior lamp walls formed by the adjacent planar faces of the press seal 20 are corner regions 24. The prior art press seal 20 shows substantially square corners 24 that are the result of the typical press sealing.

Figure 3:
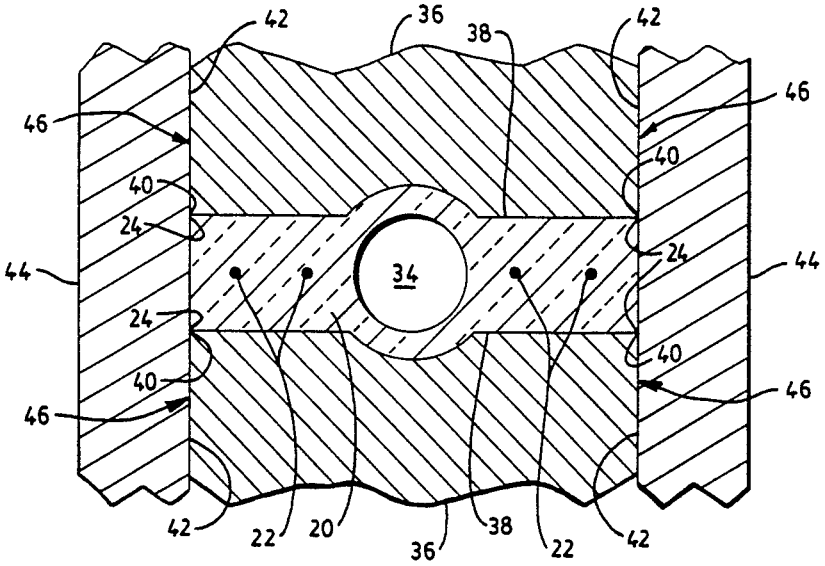
FIG. 3 PRIOR ART
FIG. 3 shows a cross sectional view, partially broken away, of a lamp press closed on the press seal of a lamp.

FIG. 3 shows a cross sectional view, partially broken away, of a typical prior art lamp press closed on a press seal. Ordinarily a heat softened envelope end is positioned between two press seal heads 36 having generally parallel, flat press faces 38 that form square press corners 40 with side faces 42. Flanking and abutting the seal heads 36 adjacent the side faces 42 are two press side plates 44. Between each side face 42 and each adjacent side plate 44 is a seam 46. The normal press sealing procedure is to close the press seal heads 36 on the softened glass. The side faces 42 are approached by the adjacent side plates 44 to narrow the seam 46. The softened glass is forced to enclose the lamp leads 22, and tubulation passage 34, if any. Excess glass oozes towards the side plates 44 where further motion is blocked. The press seal side plates 44 are then removed, and the press seal heads 36 withdrawn. The press seal 20 is then substantially rectangular with square corners 24.

Figure 4:
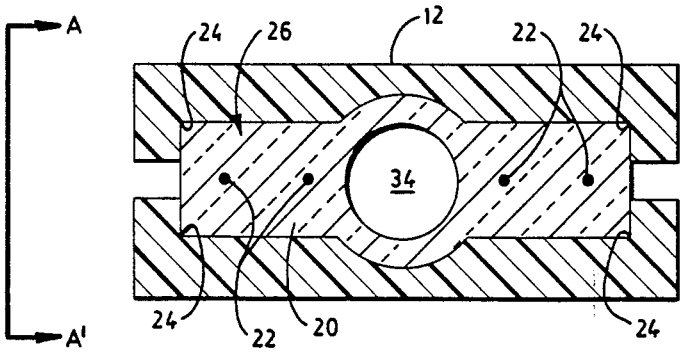
FIG. 4 PRIOR ART
FIG. 4 shows a cross sectional view along A of FIG. 1, of a prior art press sealed lamp positioned in a prior art plastic base.

The press seal 20 is then positioned in a molded base 12 having a central cavity 26 whose cross section is for the most part complementary with the cross sectional outline of the press seal 20. The molded base 12 includes a formed cavity 26 with substantially the same cross sectional outline as the press seal 20 cross section. The corresponding lamp walls of the press seal 20 and the internal cavity walls are close enough to abut when the press seal 20 is positioned in the base cavity 26. FIG. 4 shows a cross sectional view along A–A' of FIG. 1, of a prior art press seal lamp positioned in a prior art molded base 12. The rectangular press seal corners 24 fit snuggly in the corresponding rectangular corners formed in the central cavity 26 of the base 12. The press seal 20 is then securely captured, and accurately positioned with respect to the base.

Figure 5:
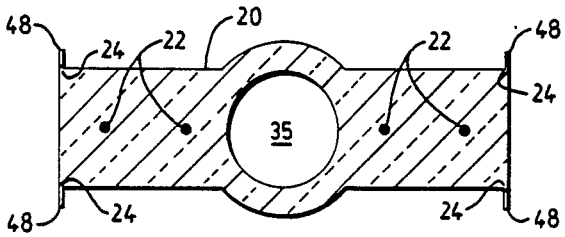
FIG. 5 PRIOR ART
FIG. 5 shows a cross sectional view a press seal formed with worn press tools.

Applicant has discovered that press seal cracking appears to be initiated at the corner region where the press seal heads 36 and press side plates 44 abut forming seams 46. Crack initiation is thought to originate in the corner regions 24 in part because of higher cooling rates, and greater surface tension. A press may make 100,000 pressings a day while subjected to the heat of molten glass. The side plates 44 cannot be lubricated because of the heat. Clearance between the press heads 36 and side plates 44 is then necessary or the tools wear rapidly. As a result of the clearance, or because of the tool wear, the softened glass may be forced between the press head 36 and side plates 44 into the seam 46. The glass flowing into the seams 46 may on cooling form a ragged edge, or a slight glass sliver extending along the press seal corner 24. The sliver is rather small, and not particularly noticeable. The ragged edge or sliver, as the case may be, are then fragile, and easily chipped away. FIG. 5 shows a crOss sectional view of a prior art press seal 20 formed with worn press tools, or offset side plates allowing a glass sliver 48 (exaggerated depiction) to be formed at the corners 24. Even when no sliver 48 is formed, the glass corner of the press seal 20 forms a fairly sharp edge which may also chip. When the fit between the press seal corner regions 24 and the molded base corner region is tight, a formed sliver 48 or sharp edged corner may be chipped away merely by inserting the press seal 20 in the base 12. Even slight chipping of a corner region 24 may occur in sliding the corner region 24 against the molded base corner. Chipping the corner region 24, even on a microscopic scale results in defects in the press seal 20. Subsequent pressure on the press seal 20, may cause the small defects in the corner regions 24 to extend slowly throughout the press seal 20, to the point of cracking the press seal 20.

Figure 6:
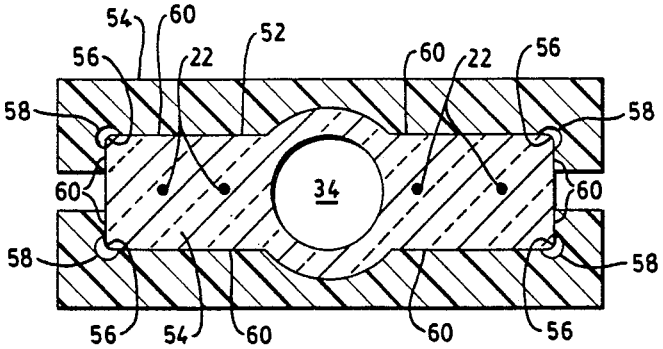
FIG. 6 shows a cross sectional view of a preferred embodiment of a press seal positioned in a preferred embodiment of a relieved lamp base.

FIG. 6 shows a cross sectional view of a preferred embodiment of a press seal 52 positioned in a preferred embodiment of a relieved lamp base 54. Internal walls of the lamp base 54 define a cavity to receive the press seal 52, such that portions of the internal walls abut portions of the press seal 52. The lamp's press seal corner regions 56 have been slightly rounded off, thereby reducing the likelihood of corner initiated cracking. The preferred method of rounding off the lamp's corner regions 56 is to flame treat the press seal 52 corner regions 56 to cause a slight surface flow or diffusion. Rounding the corner regions 56 reduces surface tension, and reduces the possibility of corner chipping. The preferred corner rounding procedure is to focus sharp gas flames on the press seal corner regions 56 where the press head seams may have left sharp or rough edges. The flames are applied briefly after press sealing. The flames are narrow enough to heat only the corner regions, and not the whole press seal. Any sliver or rough edge is then melted, but the outline of the press seal otherwise remains substantially as pressed. The lamp is then passed into an annealing process, where annealing takes place according to known procedures.

FIG. 6 also shows a preferred embodiment of the improved molded lamp base 54 having relieved base corners 58 opposite the press seal corners 56. Intermediate a first interior wall and a second interior wall and opposite the lamp corner region, a relieved wall is formed so when the press seal 52 is positioned in the base cavity the relieved wall is offset from the lamp corner region. The preferred relief is formed by slightly increasing the base cavity opposite the lamp corners 56. A small gap or offset may be formed between the press seal 52 and the lamp base 54 in the corner region. The press seal 52 may still be firmly contacted along the midsections 60 of the adjacent walls for correct lamp positioning. The positioning forces of the lamp base 54 are then placed on the planar regions intermediate, or offset from, but not on the corner regions 56 of the press seal 52. Further, since a slight gap is formed between the press seal corners 56 and the lamp base corners 58, the lamp base 54 is less likely to brush the press seal corners 56 thereby reducing the possibility of chipping or inducing other flaws in the corner region.

Figure 7:
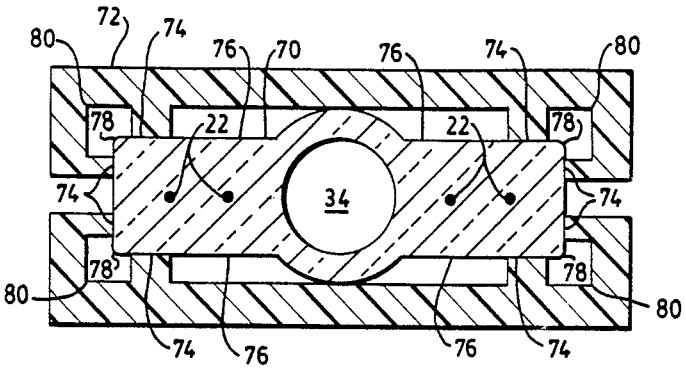
FIG. 7 shows a cross sectional view of a preferred embodiment of a press seal positioned in an alternative embodiment of a relieved lamp base.

FIG. 7 shows a cross sectional view of a press seal 70 positioned in an alternative preferred embodiment of a relieved molded lamp base 72. The internal walls of the base 72 do not need to complement exactly the cross sectional outline of the press seal 70. It is felt to be sufficient that the interior walls of the base cavity have sections 74 that contact sections of each side of the press seal 70 in an outline complementary fashion. The press seal 70 is then contacted on parts of each side. It is anticipated from the usual manufacture of the press seal 70 that there be planar sections 76 on the side of the press seal 70. Portions of the press seal 70 are then anticipated to contact corresponding, complementary sections of the molded base 72. Curved complementary or other abutting surface designs may also be accommodated. Again the press seal corner regions 78 are left free of contact with the base corner regions 80.

Figure 8:
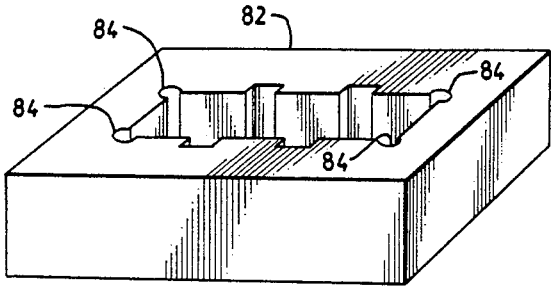
FIG. 8 shows a projection view of an alternative preferred embodiment of a relieved lamp base.

FIG. 8 shows a view of a preferred embodiment of an alternative relieved lamp base. An alternative molded base which may be broadly described as a rectangular ring is described in U.S. Pat. No. 4,724,353, which is hereby incorporated by reference. The ring type base 82 may also be improved by the inclusion of corner reliefs 84 so that the press seal midpoints or sides are the contact points, while the press seal corners remain substantially free of forces from the base.

The improved relieved molded lamp base then has a cavity formed by internal walls for receiving a press seal of an electric lamp, such that the lamp base generally does not contact regions of the press seal having sharp edges, exterior corners, chips or other areas likely to have glass defects, but does contact the press seal along planar regions less likely to have such defects. It is convenient to mold the lamp base with an interior cavity whose cross sectional outline substantially follows the cross sectional outline of the press seal to be positioned therein, with the exception that the portions of the molded base corresponding to the exterior corners of the press seal are further relieved to form a gap between the lamp base and the corner region of the press seal. The lamp and base combination is further improved by using specially applied heat to round off sharp edged areas of the press seal likely to include residual defects.

In a working example of a relieved molded base, some of the dimensions were approximately as follows: Overall, the base was 2.0 cm high, 2.25 cm wide, and 0.8 cm deep. The seal capturing end of the base was 15.5 mm wide and 2.75 mm deep. The internal cavity was centrally positioned and was 15.4 mm wide and 2.70 mm deep. A gap of 0.1 mm was formed in the two short end walls allowing a slight flexibility in the two long wall portions. The internal cavity of the lamp base was rounded out to admit the bulge of a centrally located tubulation in the press seal. Two semicircular reliefs were formed at the ends of each long wall, where each long wall formed a corner with the adjacent short wall. The reliefs were 0.75 mm in diameter. An additional relief was made in the base of the cavity adjacent the tubulation end. The tubulation relief allowed a longer tubulation which slightly reduced heating of the seal during tubulation tip off. The press seal corners were flame treated with sharply focused flames for one indexation period or about half a second to slightly round off the press seal corners. With the above reliefs made, and the lamp corners rounded off, a slight gap was formed between the lamp corner and the base corner. The lamp walls, and base walls otherwise appeared to be abutted. Crack failures in the press seals was reduced from about one lamp in a thousand to no measured crack failures. The disclosed dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A relieved, lamp base for receiving a press seal of an electric lamp, the press seal formed by exterior walls and having at least a first lamp wall, and an adjacent second lamp wall forming an intermediate lamp corner region extending in a direction substantially parallel with the first lamp wall and the second lamp wall, the relieved lamp base comprising:

(a) a plastic lamp base having internal walls defining a formed cavity to receive the press seal, (b) a first internal base wall to couple with a portion of the first lamp wall, (c) a second internal base wall to couple with a portion of the second lamp wall, (d) an internal relieved wall formed intermediate the first interior wall and second interior wall extending in a direction substantially parallel with the first interior wall and the second interior wall defining a relief cavity opposite the lamp corner region when the press seal is positioned in the base cavity whereby the relieved wall is offset from the lamp corner region.

2. The lamp base in claim 1, wherein the internal base walls define a base cavity surface substantially complementary with the lamp seal walls.

3. The lamp base in claim 1, wherein the internal base walls define a cavity surface complementary in part with only portions of the lamp seal walls.

4. A lamp and lamp base in combination comprising:

(a) a plastic lamp base having internal walls defining a formed cavity for receiving a press seal of an electric lamp, the press seal end having a first exterior lamp wall formed by a first press element, a second exterior lamp wall formed by a second press element, and a seam area formed intermediate the first exterior lamp wall and second exterior lamp wall, (b) the internal walls including a first internal base wall portion to couple with the first exterior lamp wall, a second internal base wall portion to couple with the second exterior lamp wall, (c) a relieved wall intermediate the first interior wall and second interior wall, defining a relief cavity extending in a direction substantially parallel with the first interior lamp wall and the second interior lamp wall, the relieved wall being opposite the seam area of the press seal when the press seal is positioned in the lamp base, and an electric lamp having the press seal including the first exterior lamp wall, the second exterior lamp wall, and the intermediate seam area, being inserted in the base cavity and held in position in part by coaction of the interior walls of the base cavity and the exterior walls of the press seal.

5. The apparatus in claim 4, wherein the electric lamp further has a melt rounded seam area opposite the relieved wall.

6. The apparatus in claim 5, wherein the heated rounded portions opposite the relieved wall are offset from the relieved wall.

7. A lamp and lamp base in combination comprising:

(a) a plastic lamp base having internal walls defining a formed cavity for receiving a press seal of an electric lamp, the press seal end having a first exterior lamp wall formed by a first press element, a second exterior lamp wall formed by a second press element, and a seam area formed intermediate the first exterior lamp wall and second exterior lamp wall, (b) the internal walls including a first internal base wall portion to couple with the first exterior lamp wall, a second internal base wall portion to couple with the second exterior lamp wall, (c) a relieved wall intermediate the first interior wall and second interior wall, defining a relief cavity extending in a direction substantially parallel with the first interior lamp wall and the second interior lamp wall, the relieved wall being opposite the seam area of the press seal when the press seal is positioned in the lamp base, and (d) an electric lamp having the press seal including the first exterior lamp wall, the second exterior lamp wall, and the intermediate seam area, being inserted in the base cavity and held in position in part by coaction of the interior walls of the base cavity and the exterior walls of the press seal, and further having melt rounded corner regions of the press seal, the melt rounded corner regions being opposite and offset from the relieved wall.

* * * * *